US005361750A

United States Patent [19]

Seel et al.

[11] Patent Number: 5,361,750

[45] Date of Patent: Nov. 8, 1994

[54] BURNER ASSEMBLY

[75] Inventors: Timothy P. Seel, Tonawanda; Richard H. Wojtkowski, Buffalo, both of N.Y.

[73] Assignee: Roberts-Gordon, Inc., Buffalo, N.Y.

[21] Appl. No.: 76,452

[22] Filed: Jun. 14, 1993

[51] Int. Cl.[5] ..... F24C 3/00

[52] U.S. Cl. ..... 126/91 A; 431/329; 431/351

[58] Field of Search ..... 126/91 A; 431/351, 329, 431/328

[56] References Cited

U.S. PATENT DOCUMENTS

| | | | |
|---|---|---|---|
| 2,250,680 | 7/1941 | Schlitt | 126/91 A |
| 2,664,779 | 1/1954 | White | 126/91 A |
| 2,759,473 | 8/1956 | Short . | |
| 3,329,139 | 7/1967 | Vezzoli | 431/328 |
| 4,062,343 | 12/1977 | Spielman . | |
| 4,082,497 | 4/1978 | Crawford et al. | 431/351 |
| 4,531,904 | 7/1985 | Sato et al. . | |
| 4,673,350 | 6/1987 | Collier . | |
| 4,705,022 | 11/1987 | Collier . | |
| 4,752,213 | 6/1988 | Grochowski et al. | 431/351 |
| 4,800,866 | 1/1989 | Finke . | |
| 4,813,867 | 3/1989 | Yoshida et al. . | |
| 4,869,229 | 9/1989 | Johnson . | |

FOREIGN PATENT DOCUMENTS

| | | | |
|---|---|---|---|
| 202334 | 8/1958 | Germany | 431/351 |
| 3343799 | 3/1985 | Germany . | |
| 0197709 | 9/1977 | U.S.S.R. . | |

*Primary Examiner*—Carroll B. Dority
*Attorney, Agent, or Firm*—John C. Thompson

[57] ABSTRACT

A burner assembly (10) for a radiant heater of the infrared type. The burner assembly includes a burner tube (12), a generally cylindrical mixing cup assembly (14), means (16) for mounting the cup assembly within the burner tube, means (18) for introducing air into the upstream end of the burner tube, and means (20) for introducing combustible gas into the burner cup, the gas and air being thoroughly mixed together in the burner cup. The cup assembly includes a generally cylindrical mixer tube (32), and passageway means at the downstream end, the passageway means including a ceramic block (34) and a metallic grid (36) in contact with the downstream face of the ceramic block. The ceramic block has a plurality of relatively small orifices (34.1) which extend through the block. The metallic grid (36) has a plurality of relatively small apertures (36.3) and a large central aperture (36.4). The gas is introduced into the burner cup (14c) and will totally mix with a first air portion (primary air), the gas not spilling out of the cup. The thoroughly mixed air and gas will then pass through the orifices in the ceramic block with a relatively low pressure drop and through the apertures in the metallic grid. A second air portion (secondary air) flows about the cup assembly. The grid serves as an ignition surface once a flame has been established. The foregoing design achieves substantially complete combustion and correspondingly relatively low $NO_x$ and CO emissions, and a stable cylindrical flame for more uniform heating of a cylindrical burner tube.

17 Claims, 3 Drawing Sheets

BURNER ASSEMBLY

TECHNICAL FIELD

The present invention relates generally to a burner assembly for a radiant heater of the infrared type, and more particularly to a relatively low cost burner assembly for a low intensity infrared radiant heater having a cylindrical burner tube wherein primary air is thoroughly pre-mixed with a combustible gas in a burner cup formed by a mixing cup assembly, the thoroughly pre-mixed primary air and combustible gas flowing through passageway means in the form of orifices in a ceramic block and apertures in a metallic grid to a place of ignition, and wherein secondary air passes about the mixing cup assembly, the primary air and secondary air being in unrestricted communication with each other so that after ignition the primary air and secondary air may adjust to each other in response to environmental conditions in the burner tube, the relatively low cost design achieving substantially complete combustion and correspondingly relatively low $NO_x$ and CO emissions, and a stable tubular cylindrical flame for more uniform heating of a cylindrical burner tube.

BACKGROUND OF THE INVENTION

Burner assemblies for low intensity infrared radiant heaters are well known in the art. Typical designs are shown in U.S. Pat. Nos. 2,759,473, 4,531,914, 4,062,383, 4,693,250, 4,705,022, 4,800,866, 4,813,867, and 4,869,229, German patent 3343799, and Soviet patent 197,709. These designs disclose relatively high cost complicated structures, or structures which do not achieve the relatively low $NO_x$ and CO levels achievable with the design of this invention.

Roberts-Gordon, Inc., the assignee of this patent application, also sells a low intensity radiant heating system of the type generally illustrated in the foregoing patents, the heating system being sold under the trade name VANTAGE®. While this design incorporates cost saving features not shown in the foregoing patents, it does not achieve the lowered CO and $NO_x$ emissions of the design of this invention, nor does it maintain as stable a flame during operation.

OBJECTS AND SUMMARY OF THE INVENTION

It is an object of the present invention to provide an improved, simple, relatively low cost burner assembly for a low intensity radiant heater of the type which employs an elongated burner tube wherein, during operation of the radiant heater, lower $NO_x$ and CO emissions may be achieved than are presently available with other comparable systems, and wherein the burner assembly during operation has a stable flame thereby achieving a more uniform heating of the elongated burner tube than available with other prior art designs, and which will also achieve longer life of the burner tubes.

In summary, the foregoing is achieved by mounting a generally cylindrical mixing cup assembly at least partially within an elongated generally cylindrical burner tube. The mixing cup assembly includes a generally cylindrical mixer tube, having upstream and downstream ends. The downstream end is closed by passageway means including a ceramic block. The mixer tube and the ceramic block form a burner cup. The passageway means also includes a metallic grid in contact with the downstream face of the ceramic block. The ceramic block has a plurality of relatively small orifices which extend through the block from the upstream face of the block to the downstream face permitting a flow of gas through the block with a relatively small pressure drop. The metallic grid has a plurality of relatively small apertures. Means are provided for introducing primary and secondary air into the upstream end of the mixer tube and the upstream end of the burner tube. Means are also provided for introducing combustible gas into the burner cup, the gas being introduced in such a manner that it will totally mix with primary air, the gas not spilling out of the burner cup. The thoroughly mixed primary air and combustible gas will pass through the orifices in the ceramic block and the apertures in the metallic grid. The secondary air flows about the mixing cup assembly in a direction generally parallel to the axis of the mixer tube until it passes the downstream end of the mixer tube when it enters the combustion zone of the burner tube without restriction. The primary air and secondary air are in direct communication with each other as the mixing cup assembly is open where the primary air is introduced and since there are no restrictions between the inner surface of the burner tube and the outer surface of the mixing cup assembly. This permits the burner assembly, after ignition, to adjust primary to secondary air ratios in response to environmental conditions in the combustion zone within the burner tube. The metallic grid has a relatively large central aperture so that, after a flame has been established, a stable tubular cylindrical flame will extend away from the burner assembly, the grid serving as an ignition surface once a flame has been established. The balance tubular cylindrical flame will heat the burner tube as evenly as possible along its length without hot spots.

The above object and other objects and advantages of this invention will become more apparent after a consideration of the following detailed description taken in conjunction with the accompanying drawings in which the preferred form of this invention is illustrated.

DETAILED DESCRIPTION

The burner assembly of the present invention is indicated generally at 10 in the accompanying figures. The burner assembly includes, as its major components, a burner tube 12, a generally cylindrical mixing cup assembly, indicated generally at 14, the cup assembly forming a burner mixing cup, and mounting means for mounting the mixing cup assembly within the burner tube, the mounting means being indicated generally at 16. The burner assembly also includes means for introducing air into the upstream end of the burner and the burner cup tube, this means being indicated generally at 18, and means for introducing combustible gas into the burner cup, the gas introducing means being indicated generally at 20. The portion of the air which enters the burner cup is referred to as primary air, and the portion of the air which flows about the mixing cup assembly is called secondary air.

The means 18 for introducing air into the upstream end of the burner tube includes a blower assembly indicated generally at 21, the blower assembly being supported by a housing 22. The housing 22 also supports the means for introducing combustible gas into the burner cup. The housing 22 is connected to one end of the burner tube 12 introducing gas into the burner cup, and the housing additionally supports one end of the burner tube 12.

Figure 1:
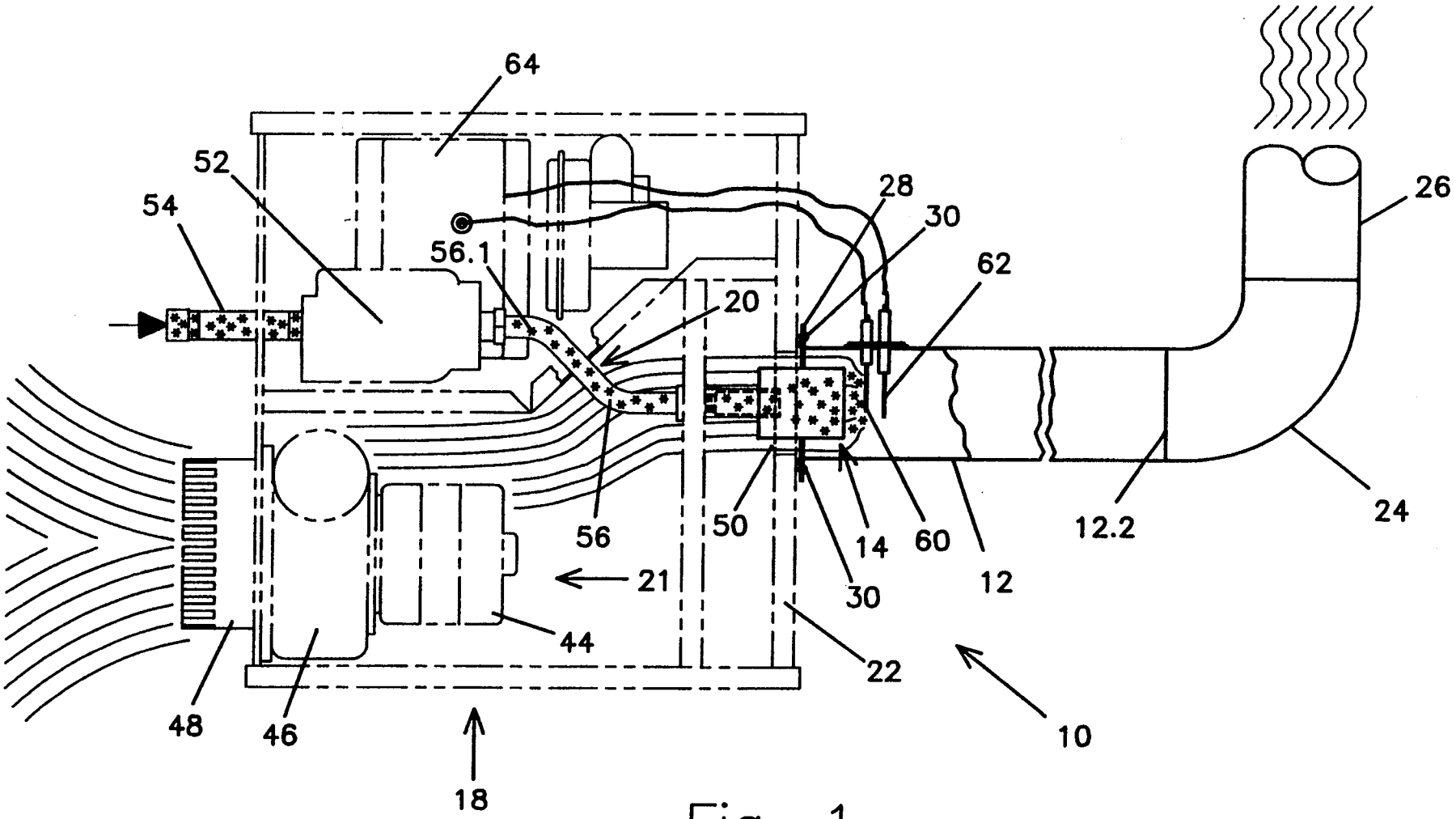
FIG. 1 is a side elevational view of a radiant heating system to which the burner assembly of this invention has been applied.

The burner tube 12 has an upstream end 12.1 and a downstream end 12.2. The downstream end 12.2 of the burner tube 12, which may also be called a radiant tube, is connected to a flue connector 24 which is in turn connected to a flue 26, the flue in turn being vented to the outside of a building. The burner tube 12 is secured to the housing in any conventional manner. As shown in the drawings, the upstream end 12.1 of the burner tube 12 is provided with a radially outwardly extending flange 12.11. An apertured mounting plate 28 (FIG. 1) is slidably received about the radiant tube 12 and can be brought to bear against the flange 12.11. When in the flange engaging position, the plate may then be secured to the housing 22 by conventional fasteners 30.

The principal components of the generally cylindrical mixing cup assembly 14 are a generally cylindrical mixer tube 32, and passageway means in the form of a ceramic block 34 which closes off one end of the mixer tube, and a metallic grid 36 in contact with the ceramic block. The generally cylindrical mixer tube 32 has an upstream end 32.1 and a downstream end 32.2. The ceramic block 34 is cut approximately 0.5 inches (1.25 cm) thick and is cut in such a manner that its outer edge is snugly received within the inner tube surface 32.3 adjacent the downstream end 32.2. The ceramic block is secured thereto in any conventional manner, such as, for example, by a high temperature adhesive or cement 37. The upstream surface of the ceramic block and the inner tubular surface 32.3 upstream of the ceramic block form a burner cup 14c. The ceramic block is provided with a plurality of relatively small orifices 34.1 which extend entirely through the ceramic block from the upstream face 34.2 to the downstream face 34.3. The orifices are so dimensioned that there will be a relatively small pressure drop when mixed primary air and combustible gas flow from the burner cup through the ceramic block. In practice, it has been found that satisfactory results can be achieved if there are 15–25 orifices per linear inch. The metallic grid 36 is mounted in such a manner that its upstream face 36.1 is in contact with the downstream face 34.3 of the ceramic block.

Figure 4:
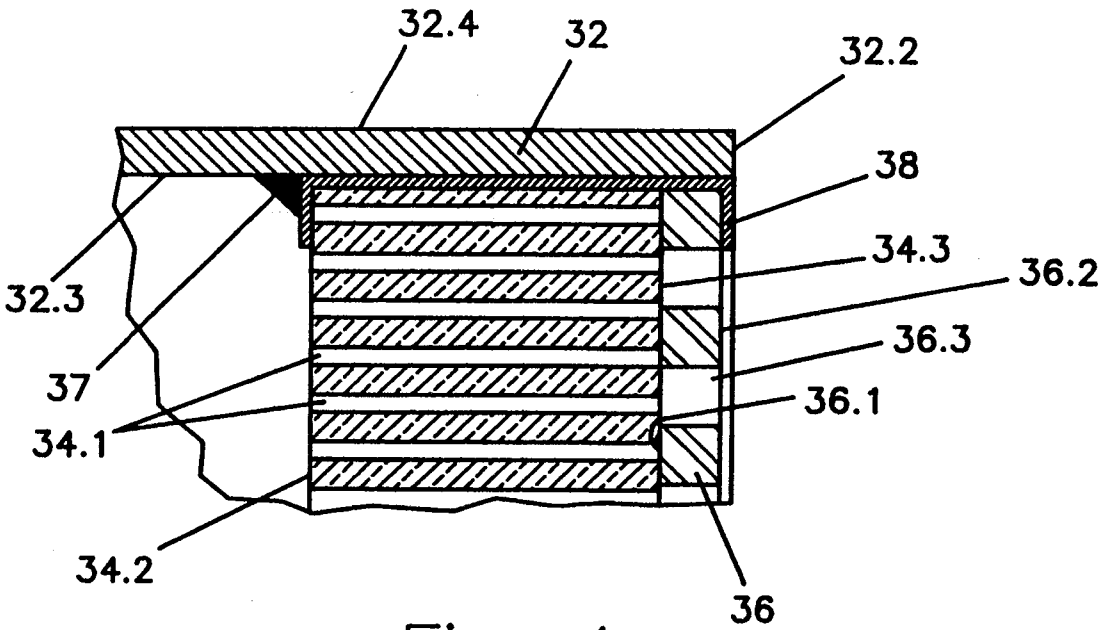
FIG. 4 is an enlarged sectional view of a portion of the mixing cup assembly used in the burner assembly shown in FIG. 2.

During operation of the burner assembly, the downstream face 36.2 of the metallic grid will, after initial start-up, act as an ignition surface. The grid 36 is provided with a plurality of relatively small apertures 36.3, there being approximately 5 per linear inch, each aperture having a diameter of about 0.12 inches (0.3 cm). In addition, the metallic grid is provided with a large central aperture 36.4 having a diameter of approximately 1.5 inches (3.75 cm). As the downstream face 36.2 of the metallic grid acts as an ignition surface, by removing the central portion of the grid, the flame, after start-up, inherently has a tubular cylindrical shape. The mixture of combustible gas and air, which passes through the large central aperture 36.4, can continue to feed the flame downstream of the cup assembly. While the grid 36 may be positioned in any manner with its upstream face 36.1 in contact with the downstream face 34.2 of the ceramic block, in practice the grid has been clipped to the ceramic block by a metallic clip 38 (FIG. 4), there being two diametrically opposed clips, each clip having a width of approximately 0.5 inches (1.25 cm). The ceramic block 34 and grid 36 are thus formed as a subassembly by the metallic clip 38 and as they have an overall diameter of approximately 2.5 inches (6.5 cm), which is the internal diameter of the mixer tube, they can then be bonded in place at the downstream end of the mixer tube by any suitable high temperature cement or the like.

Figures 2, 3:
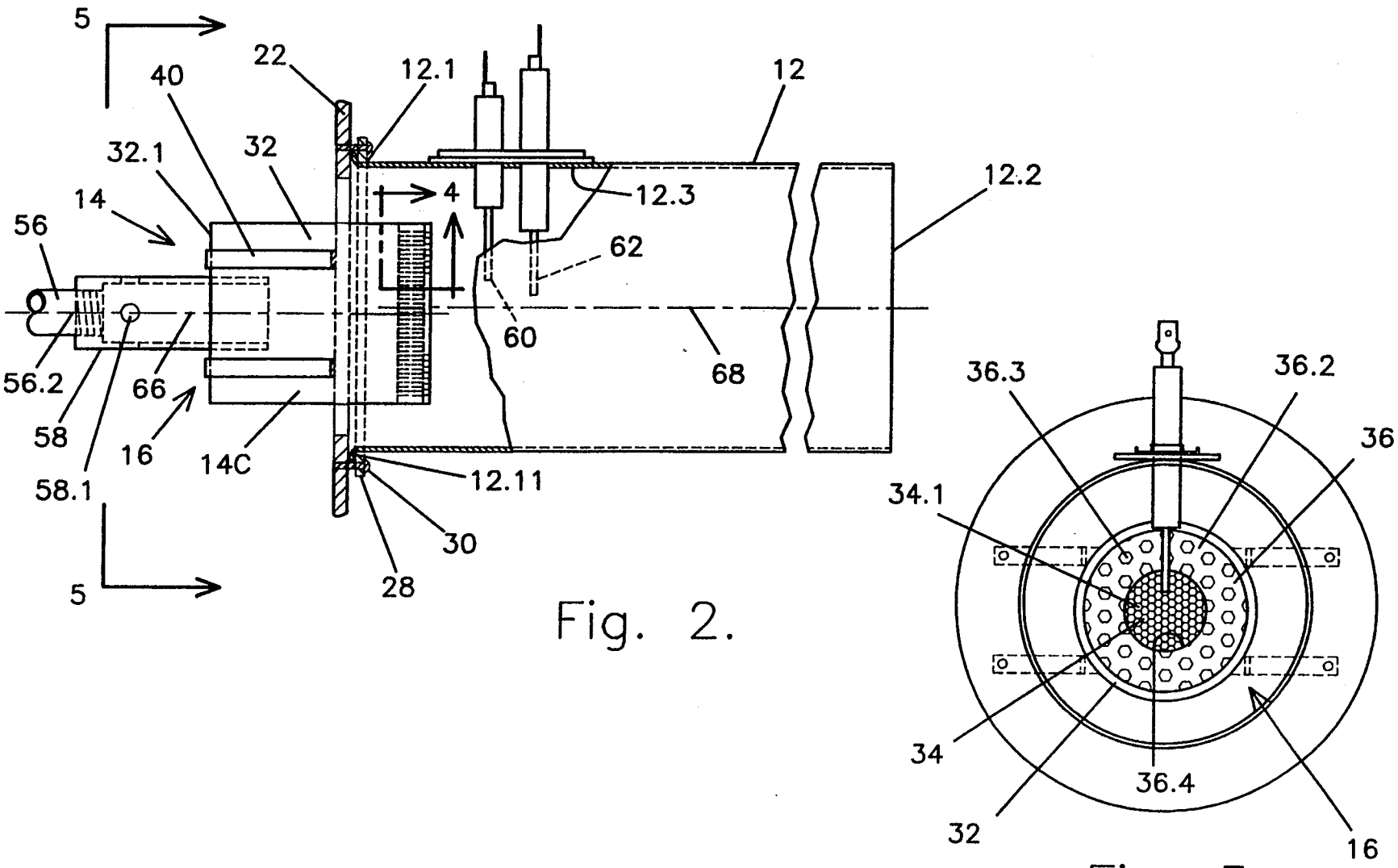
FIG. 2 is a side elevational view, partially in section, of the burner assembly shown in FIG. 1.
FIG. 3 is an end view of the burner assembly shown in FIG. 2.
Figure 5:
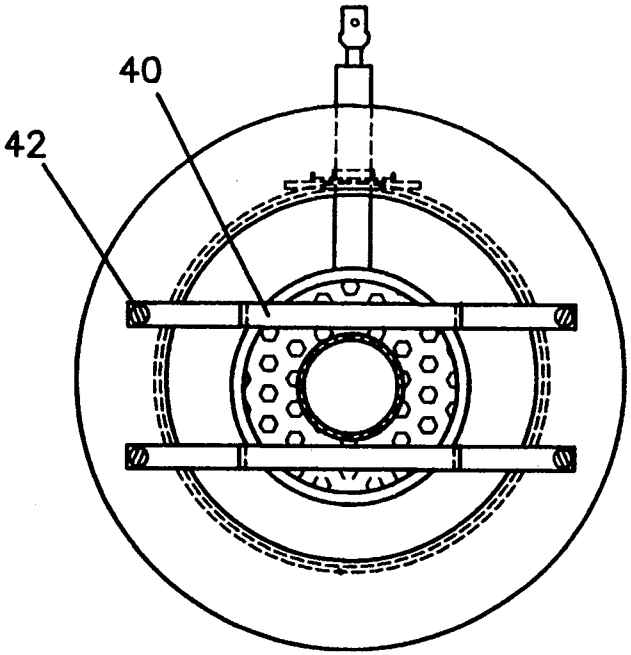
FIG. 5 is a sectional view taken generally along the line 5—5 in FIG. 2.

The mounting means indicated generally at 16 include two generally U-shaped brackets 40 which are preferably spot-welded to the outer surface 32.4 of the mixer tube. The U-shaped bracket will support the mixer tube in such a manner that there is a clearance of at least 0.45 inches (1.14 cm) at the bottom (as seen in FIG. 3) between the inner tubular surface 12.3 of the burner tube and the exterior surface 32.4 of the mixer tube. The brackets are in turn secured to the housing 22 by means of screws 42 or any other conventional fastener. As can be seen from the figures of this application, in the preferred form the burner tube 12 will extend horizontally, and the brackets 40 will support the mixer tube in such a manner that its centerline is slightly below the centerline of the burner tube.

As previously mentioned, the means for introducing air into the upstream end of the burner tube includes a housing 22 which supports a blower assembly 21. The blower assembly includes a motor 44 which drives a conventional blower 46, the blower 46 receiving ambient air through an air filter 48 mounted upon the exterior surface of the housing 22, ambient air passing through the filter 48 and through a suitable aperture or apertures (not shown) in the wall of the housing, the air being discharged by the blower into the interior of the housing 22. The housing 22 is provided with a large aperture 50 through which the pressurized air within the housing may be discharged, the upstream end 12.1 of the burner tube being disposed about or being secured to the housing about the aperture 50.

The means for introducing combustible gas into the burner tube include a gas valve or regulator 52, which may be mounted within the housing, the valve or regulator receiving pressurized combustible gas through a supply line 54. A gas line 56 extends between the valve 52 and the mixing cup assembly, the upstream end 56.1 of the gas line being secured to the valve 52 in any conventional manner. In the preferred embodiment, the downstream end 56.2 of the gas line includes a burner throat 58, which throat 58 will have a larger internal diameter than the gas line 56. In any event the gas line or burner throat terminates in the mixing cup assembly 14 between the upstream end 32.1 of the mixer tube and the upstream face 34.2 of the ceramic block in such a manner that the combustible gas will not spill out of the burner cup assembly and will thoroughly mix with primary air within the burner cup assembly, the thoroughly mixed air and combustible gas passing through the orifices 34.1 in the ceramic block and the apertures 36.3 in the metallic grid. In order to facilitate the mixing of gases within the burner cup the burner throat is provided with apertures 58.1 which permit a small amount of primary air to enter the throat. The entering primary air in turn creates turbulence within the burner throat which in turn facilitates the mixing of the gas with primary air within the burner cup.

After the flow of air and gas has been initiated they will be ignited by ignition means which includes an igniter which includes an insulated high tension electrode 60, and a ground electrode (not shown). A sensor 62 will be mounted adjacent the electrode 60.

The ignition sequence is as follows: The blower motor 44 will cause the operation of the blower 46. After a switch (not shown) within the housing 22 senses pressurized air, the igniter control module 64 will open the gas valve 52 to cause combustible gas to flow into the burner cup 14*c*, the gas thoroughly mixing with primary air within the burner cup, the thoroughly mixed gas and air then flowing through the orifices 34.1 and apertures 36.3 and 36.4. Just prior to ignition, there will be higher pressure within the burner cup 14*c* and lower pressure outside and about the burner cup, causing there to be a consequently rich gas/air mixture. The control module will also cause the high tension electrode to spark causing ignition of the initially rich gas/air mixture. (If the sensor 62 does not sense ignition after a suitable time period, the valve 54 will be closed). When the gas and air mixture ignites, the flame will push away from the downstream surface of the metallic grid 36 and it will tend to consume secondary air which flows about the mixer tube 32. As the flame continues to burn, it will establish, within a very short period of time, a stable condition, with the flame being ignited by the hot surface 36.2 of the metallic grid 36, and with primary air introduced into the burner tube through the aperture 50 thoroughly mixing with gas within the burner cup 14, and with secondary air passing through the annular space about the cup assembly 14 and the inner surface 12.3 of the burner tube.

It has been found with the design shown in the accompanying drawings that low $NO_x$ and CO emissions are achieved over a variety of firing rates as there is substantially complete combustion of all gas within the burner tube due to the total pre-mix which is achieved in the burner cup 14*c*. In addition, it has been found that because of the stability of the flame there are very few hot spots within the burner tube. As the flame will tend to rise slightly, the mixing cup assembly 14 is mounted off center with its centerline 66 being disposed slightly below the centerline 68 of the burner tube. The position of the discharge end of the gas line 56 or burner throat 58 within the cup is critical. If it is not in far enough, the combustible gas will spill out of the cup and go around the cup, mixing with the secondary air. However, if the end of the gas line or burner throat is too far into the cup, the combustible gas will not thoroughly mix with the primary air within the cup. The precise position will be determined by experimentation. But when using a 3 inch (7.5 cm) long mixer tube, having a diameter of 2.5 inches (6.5 cm), and when using a ceramic block 34 having a thickness of 0.5 inches (1.25 cm), it has been found that good results have been achieved when the terminal end of the gas line is disposed 0.75 inches (1.9 cm) into the cup.

This design also facilitates a low pressure/high pressure "balancing" relationship which occurs at the burner cup to better emissions. This is especially important in a positive pressure burner in that there is generally no way for a standard burner of this type to maintain good combustion when an environmental variable (for example back pressure) changes. The new burner design, while it cannot vary the overall fuel/air ratio during an environmental disturbance, can by virtue of the pressure balancing of secondary air and gas/primary air mix, make the most out of what is available, ensuring low emissions over a wider range than a typical "in-shot" type positive pressure burner. Also, this balancing tends to promote the cylindrical nature of the flame. This is particularly important as it is desirable to heat the burner tube as evenly as possible along its length. Testing has already demonstrated that heat is released more evenly and this heat can be released utilizing a smaller surface area. In other words, average radiant output per length of heat exchanger has increased without any of the usual "hot spotting" seen in a more conventional design.

While a preferred form of this invention has been described above and shown in the accompanying drawings, it should be understood that the applicant does not intend to be limited to the particular details described above and illustrated in the accompanying drawings, but intends to be limited only to the scope of the invention as defined by the following claims.

What is claimed is:

1. A burner assembly for a radiant heater, the radiant heater including an elongated low intensity radiant heating burner tube having an upstream end, a downstream end, and a generally cylindrical inner surface, and the burner assembly after ignition adjusting primary to secondary air ratios in response to environmental conditions in the firing zone within the burner tube; said burner assembly comprising:

a generally cylindrical mixing cup assembly disposed within the burner tube, said mixing cup assembly including a generally cylindrical mixer tube having an open up-stream end, a downstream end, and a generally cylindrical outer surface, and a ceramic block closing the downstream end of the mixer tube, the ceramic block having upstream and downstream faces, the ceramic block being provided with a plurality of relatively small orifices which extend through the block from the upstream face to the downstream face permitting a flow of gas through the block with a relatively small pressure drop;

mounting means for mounting the mixing cup assembly within the burner tube with the mixing cup assembly being spaced away from the generally cylindrical inner surface of the burner tube;

means for providing a source of pressurized air to the burner assembly including primary and secondary air, the primary air flowing through the mixer tube secondary air flowing about the outer surface of the mixer tube generally parallel to the axis of the mixer tube until it passes the downstream end of the mixer tube where it enters the burner tube without restriction, the primary and secondary air being direct communication with each other;

means for introducing combustible gas into the mixing cup assembly, said means being a gas line, one end of the gas line being provided with apertures in communication with said source of pressurized air, said end of the gas line being connected to a source of gas under pressure via a valve and the other end of the gas line terminating in the mixing cup assembly between the open upstream end of the mixer tube and the ceramic block, the gas thoroughly mixing within the mixing cup assembly with primary air, the gas not spilling out of the mixing cup assembly and the mixed primary air and gas passing through the passageway means to a place of ignition; and means within the burner tube to ignite the thoroughly mixed gas and primary air downstream of the passageway means.

2. The burner assembly as set forth in claim 1 wherein the burner tube has a diameter of about 4 inches (10 cm) and the cylindrical mixer tube has a diameter of about 2.5 inches (6.5 cm).

3. The burner assembly as set forth in claim 1 or claim 2 wherein the length of the mixer tube is about 3 inches (7.5 cm).

4. The burner assembly as set forth in claim 1 wherein the means for providing air is a blower assembly, the blower assembly including a housing, the upstream end of the burner tube being secured to the housing, the housing having an aperture through which air can pass to the burner tube, and the blower assembly further including a blower supported by the housing, the blower being capable of introducing ambient air into the housing under pressure, the pressurized ambient air flowing through the aperture in the housing into the upstream end of the burner tube.

5. The burner assembly as set forth in either claim 1 or claim 4 wherein the elongated low intensity radiant heating burner tube is horizontally disposed, and wherein the mounting means for mounting the mixing cup assembly within the burner tube is a bracket which supports the mixer tube in such a manner that its center line is slightly below the center line of the burner tube.

6. The burner assembly as set forth in claim 5 wherein the mounting means mounts the mixing tube within the burner tube in such a manner that there is a clearance of at least 0.45 inches (1.14 cm) between the inner surface of the burner tube and the outer tubular surface of the mixer tube, the mounting means being a bracket which engages the housing.

7. The burner assembly as set forth in claim 1 wherein the mixing cup assembly further includes a metallic grid having upstream and downstream faces, the upstream face of the grid being in contact with the downstream face of the ceramic block, the grid being provided with a plurality of relatively small apertures which extend through the grid from the upstream face to the downstream face to permit a flow of gas through the grid.

8. The burner assembly as set forth in claim 7 wherein the ceramic grid is about 0.5 inches (1.25 cm) thick.

9. The burner assembly as set forth in either claim 7 or claim 8 wherein there are about 15–20 orifices per linear inch in the ceramic block.

10. The burner assembly as set forth in claim 7 wherein the metallic grid has about 5 relatively small apertures per linear inch.

11. The burner assembly as set forth in either claim 7 or claim 10 wherein the metallic grid has a large central aperture.

12. The burner assembly as set forth in claim 11 wherein the large central aperture is about 1.5 inches (3.75 cm) in diameter.

13. A burner assembly for a radiant heater; said assembly comprising:

an elongated radiant heating burner tube having an upstream end and a downstream end, the burner tube having a generally cylindrical inner surface;

a generally cylindrical mixing cup assembly disposed within the burner tube, said mixing cup assembly including a generally cylindrical mixer tube having an upstream end and a downstream end, a ceramic block closing the downstream end of the mixer tube, the ceramic block having upstream and down-stream faces, the ceramic block being provided with a plurality of relatively small orifices which extend through the block from the upstream face to the downstream face permitting a flow of gas through the block with a relatively small pressure drop, and a metallic grid having upstream and downstream faces, the upstream face of the grid being in contact with the downstream face of the ceramic block, the grid being provided with a plurality of relatively small apertures which extend through the grid from the upstream face to the downstream face to permit a flow of gas through the grid, the metallic grid having a large central aperture;

mounting means for mounting the mixing cup assembly within the burner tube with the mixing cup assembly being spaced away from the generally cylindrical surface of the burner tube;

means for introducing pressurized air into the upstream end of the burner tube; and gas line means for introducing combustible gas into the mixing cup assembly, the gas line means extending into the mixing cup and spaced therefrom so that air can pass about the gas line means and mix within the mixing cup assembly with the combustible gas, the gas not spilling out of the mixing cup assembly and the mixed air and gas passing through the orifices in the ceramic block and the apertures in the metallic grid, a second portion of the air introduced into the burner tube flowing about the mixing cup assembly.

14. The burner assembly as set forth in claim 13 wherein the burner tube has a diameter of about 4 inches (10 cm) and the cylindrical mixer tube has a diameter of about 2.5 inches (6.5 cm).

15. The burner assembly as set forth in claim 13 wherein the length of the mixer tube is about 3 inches (7.5 cm).

16. The burner assembly as set forth in either claim 13 wherein the mounting means for mounting the mixing cup assembly within the burner tube is a bracket which supports the mixer tube in such a manner that its center line is slightly below the center line of the burner tube.

17. The burner assembly as set forth in claim 13 wherein the large central aperture is about 1.5 inches (3.75 cm) in diameter.

* * * * *

UNITED STATES PATENT AND TRADEMARK OFFICE

CERTIFICATE OF CORRECTION

PATENT NO. : 5,361,750

DATED : Nov. 8, 1994

INVENTOR(S) : Timothy P. Seel et al

It is certified that error appears in the above-identified patent and that said Letters Patent is hereby corrected as shown below:

Col. 6, line 37, change the spelling of "up-stream" to --upstream--.

Col. 6, line 53, insert --and the--after "mixer tube".

Col. 6, lines 62-64, delete "being provided with apertures in communication with said source of pressurized air, said end of the gas line".

Col. 6, line 66, after "gas line" insert --being provided with apertures in communication with said source of pressurized air, said end of the gas line--.

Signed and Sealed this

Seventh Day of February, 1995

*Attest:*

Bruce Lehman

BRUCE LEHMAN

*Attesting Officer*

*Commissioner of Patents and Trademarks*